US008845377B2

(12) United States Patent
Berenson

(10) Patent No.: US 8,845,377 B2
(45) Date of Patent: Sep. 30, 2014

(54) FLOATING TOY CONSTRUCTION WITH IMPROVED SAFETY FEATURES

(75) Inventor: Steven M. Berenson, Canton, MA (US)

(73) Assignee: Aqua-Leisure Industries, Inc., Avon, MA (US)

( * ) Notice: Subject to any disclaimer, the term of this patent is extended or adjusted under 35 U.S.C. 154(b) by 113 days.

(21) Appl. No.: 13/484,398

(22) Filed: May 31, 2012

(65) Prior Publication Data

US 2013/0323992 A1 Dec. 5, 2013

(51) Int. Cl.
*B63C 9/28* (2006.01)

(52) U.S. Cl.
USPC ..... 441/131; 441/130; 441/129

(58) Field of Classification Search
USPC ..... 441/129–131
See application file for complete search history.

(56) References Cited

U.S. PATENT DOCUMENTS

| | | | | | |
|---|---|---|---|---|---|
| 2,075,374 | A * | 3/1937 | Tucker | 441/131 |
| 2,562,080 | A * | 7/1951 | Barnes | 441/131 |
| 2,724,843 | A * | 11/1955 | Kimball | 441/131 |
| 4,464,132 | A * | 8/1984 | Mauck | 441/81 |
| 4,799,910 | A * | 1/1989 | Kellough | 441/131 |
| 4,979,249 | A * | 12/1990 | Meade, II | 5/644 |
| 5,046,978 | A * | 9/1991 | Howerton | 441/131 |
| 5,058,522 | A * | 10/1991 | Bauer | 114/351 |
| 5,090,930 | A * | 2/1992 | Walden | 441/131 |
| 5,766,052 | A * | 6/1998 | Metro et al. | 441/130 |
| 6,126,504 | A * | 10/2000 | Day | 441/131 |
| 6,347,971 | B1 * | 2/2002 | Berke et al. | 441/129 |
| 6,394,868 | B1 * | 5/2002 | Katz | 441/130 |
| 7,008,281 | B2 * | 3/2006 | Ketko | 441/130 |
| 7,926,135 | B1 * | 4/2011 | Leach | 5/655 |
| D655,364 | S * | 3/2012 | Johnston | D21/805 |
| D672,596 | S * | 12/2012 | Sclare | D6/601 |
| 2013/0323992 | A1 * | 12/2013 | Berenson | 441/131 |

* cited by examiner

*Primary Examiner* — Lars A Olson
*Assistant Examiner* — Jovon Hayes
(74) *Attorney, Agent, or Firm* — Lando & Anastasi, LLP

(57) ABSTRACT

According to one aspect, embodiments of the invention provide a construction for a float, the construction comprising a flotation device having a top portion, a bottom portion and an opening disposed through the top portion and the bottom portion, a seat portion located proximate the bottom portion of the flotation device, and a side wall coupled between the seat portion and an edge of the opening, wherein the seat portion is configured to support a user at a location proximate the bottom portion of the flotation device.

17 Claims, 8 Drawing Sheets

FLOATING TOY CONSTRUCTION WITH IMPROVED SAFETY FEATURES

BACKGROUND OF THE DISCLOSURE

1. Field of the Invention

At least one example in accordance with the present invention relates generally to floating pool and beach toys for babies and toddlers.

2. Discussion of Related Art

Floating pool and beach toys are oftentimes utilized to keep a young child, such as a baby or toddler, floating at the surface of a body of water while preventing the child from becoming submerged in the water.

SUMMARY

Aspects in accord with the present invention are directed to a construction for a float, the construction comprising a flotation device having a top portion, a bottom portion and an opening disposed through the top portion and the bottom portion, a seat portion located proximate the bottom portion of the flotation device, and a side wall coupled between the seat portion and an edge of the opening, wherein the seat portion is configured to support a user at a location proximate the bottom portion of the flotation device.

According to one embodiment, the side wall comprises a first portion coupled to the flotation device around the edge of the opening and a second portion coupled to an edge of the seat portion. In one embodiment, the side wall extends downward from the edge of the opening towards the bottom portion of the flotation device. In another embodiment the side wall is beveled in relation to the top and bottom portions of the flotation device.

According to another embodiment, the construction further comprises a keel coupled to the bottom portion of the flotation device. In one embodiment, the keel is weighted with water.

According to one embodiment, the construction further comprises a size compensator, wherein the size compensator is configured to be inserted into the flotation device through the opening and located proximate the seat portion. In one embodiment, the size compensator is removable from the flotation device. In another embodiment, the size compensator includes at least two pieces. In one embodiment, the size compensator is inflatable.

According to another embodiment, the flotation device is an inflatable tube having a cross sectional diameter of between eight to ten inches.

Another aspect in accord with the present invention provides a construction for a float, the construction comprising a flotation device having a top portion, a bottom portion and an opening disposed through the top portion and the bottom portion, a seat portion located within the opening, and a size compensator, wherein the size compensator is configured to be inserted into the flotation device through the opening and to be located proximate the seat portion, and wherein the size compensator is further configured to encompass a portion of a user supported by the seat portion.

According to one embodiment, the size compensator is removable from the flotation device. In one embodiment, the size compensator includes at least two pieces. In another embodiment, the size compensator is inflatable.

According to another embodiment, the construction further comprises a side wall coupled between an edge of the opening and an edge of the seat portion, wherein the seat portion is located proximate the bottom portion of the flotation device. In one embodiment, the side wall extends downward from the edge of the opening towards the bottom portion of the flotation device. In another embodiment, the side wall is beveled in relation to the top and bottom portions of the flotation device.

According to one embodiment, the flotation device is an inflatable ring having a cross sectional diameter of between eight to ten inches. In another embodiment, the construction further comprises a keel coupled to the bottom portion of the flotation device.

BRIEF DESCRIPTION OF DRAWINGS

The accompanying drawings are not intended to be drawn to scale. In the drawings, each identical or nearly identical component that is illustrated in various FIGs. is represented by a like numeral. For purposes of clarity, not every component may be labeled in every drawing. In the drawings.

DETAILED DESCRIPTION OF THE PREFERRED EMBODIMENTS

Figure 1A:
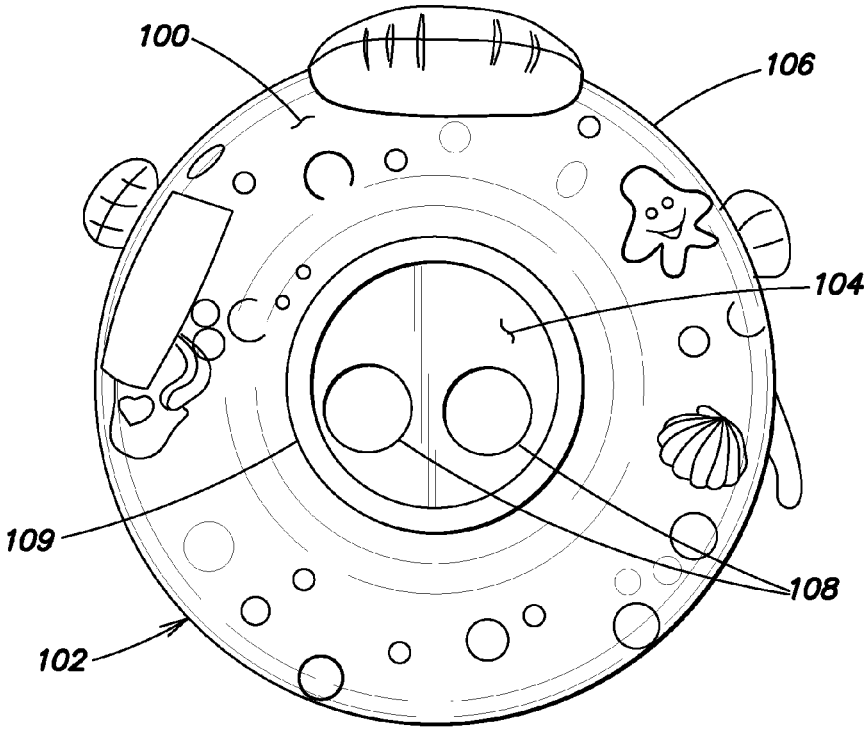
FIG. 1A is a top view diagram of a floating pool and beach toy in accordance with aspects of the present invention.

For the purposes of illustration only, and not to limit the generality, the present disclosure will now be described in detail with reference to the accompanying figures. This disclosure is not limited in its application to the details of construction and the arrangement of components set forth in the following description or illustrated in the drawings. The disclosure is capable of other embodiments and of being practiced or being carried out in various ways. Also the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

As described above, floating pool and beach toys are oftentimes utilized to keep a young child, such as a baby or toddler, floating at the surface of a body of water while preventing the child from becoming submerged in the water. However, conventional pool and beach toys may have buoyancy, stability, and/or safety problems. For example, typical pool and beach toys may be relatively easy to tip over (e.g., by a child seated in the toy leaning too far over an edge of the toy), creating a potentially dangerous situation.

As such, embodiments of the current invention provide a baby boat construction with improved features that provide enhanced stability, buoyancy and safety.

Figure 1B:
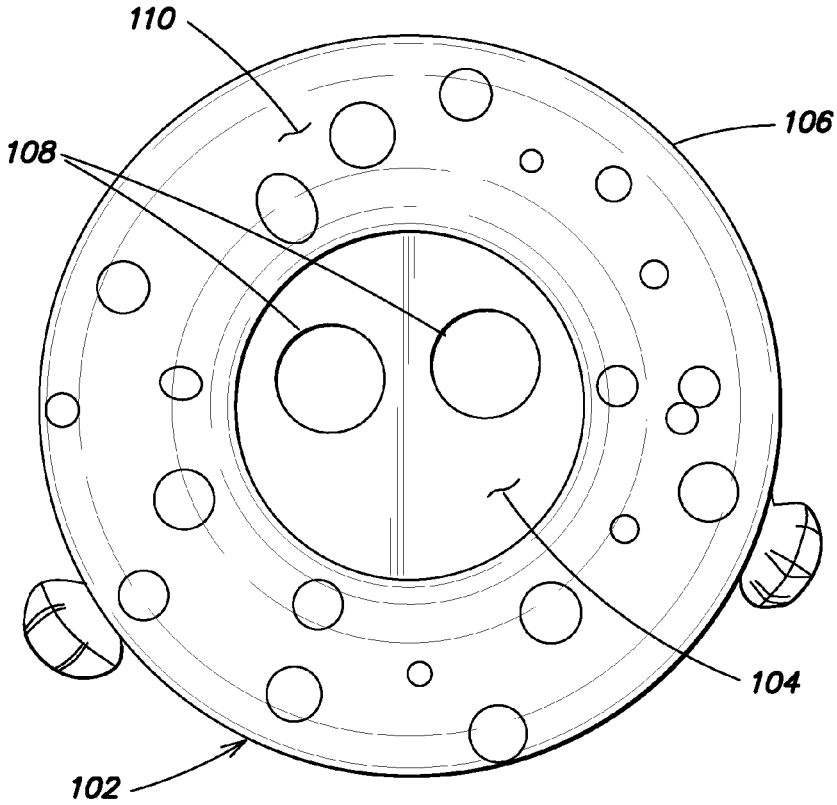
FIG. 1B is a bottom view diagram of a floating pool and beach toy in accordance with aspects of the present invention.

FIGS. 1A and 1B illustrate a floating pool and beach toy in accordance with aspects of the present invention. As seen in the top view 100 of FIG. 1A and in the bottom view 110 of FIG. 1B, the toy 102 includes a seat portion 104 affixed to and surrounded by a flotation device 106. The seat portion 104 including apertures 108 that receive a young child's legs (not shown). The seat portion 104, in cooperation with the flotation device 106, supports the weight of the child and keeps the child afloat while the flotation device 106 rests on top of the water. According to one embodiment, the floating pool and beach toy 102 also includes a variety of features that may enhance the stability, buoyancy and safety of the toy 102.

Figure 2:
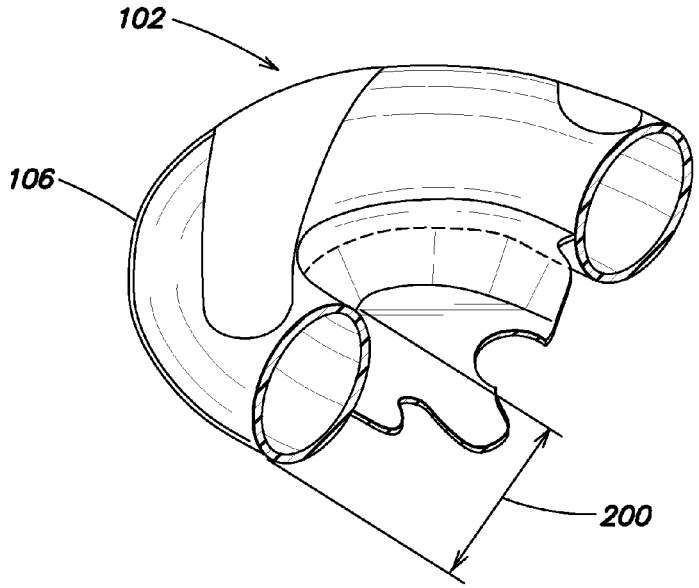
FIG. 2 is a cross sectional diagram of a flotation device of a floating pool and beach toy in accordance with aspects of the present invention.

According to one embodiment, the floating pool and beach toy 102 includes a flotation device 106 in the form of an inflatable tubular ring. FIG. 2 is a cross sectional diagram of a flotation device 106. According to one embodiment, the flotation device 106 has a cross sectional diameter 200 of between eight and ten inches. However, in other embodiments, the size of the flotation device 106 may be configured differently. The flotation device 106 may provide enhanced buoyancy, stability and safety to a young child sitting in the toy 102.

Figure 3A:
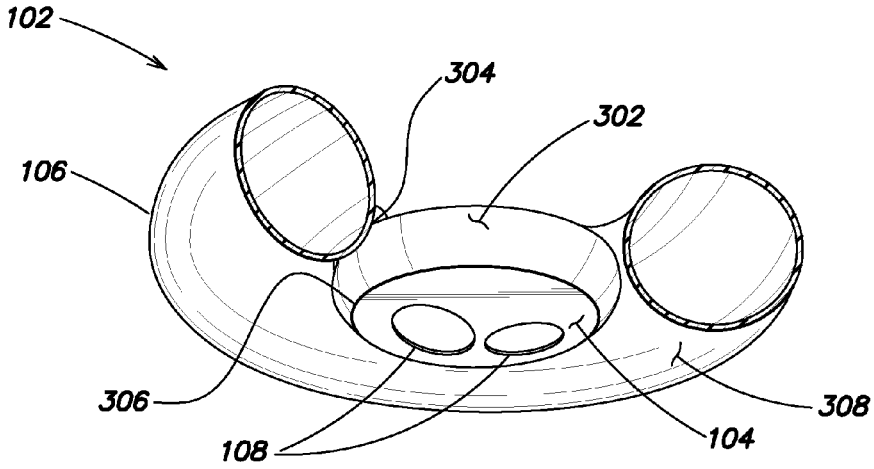
FIG. 3A is a cross sectional diagram of a floating pool and beach toy including a bucket seat in accordance with aspects of the present invention.

According to another embodiment, the seat portion 104 of the floating pool and beach toy 102 is configured as a "bucket" seat. For example, as seen in FIG. 3A, the seat portion 104 is coupled to the flotation device 106 via a circular side wall 302. According to one embodiment, the side wall 302 is welded to both the flotation device 106 and the seat portion 104. In one embodiment, the side wall 302 is welded to the flotation device 106 around an edge 304 of the flotation device 106. In one embodiment, the side wall 302 is welded to the seat portion 104 around an edge 306 of the seat portion 104.

According to one embodiment, the side wall 302 extends downward from the edge 304 to the seat portion 104, which is located below the edge 304 and proximate a bottom portion 308 of the flotation device 106, creating a bucket seat. By locating the seat portion below the edge 304 and proximate the bottom portion 308, a child sitting on the seat portion 104, with his/her feet through the apertures 108, will actually be sitting within the toy 102, closer to the bottom portion 308 (i.e. closer to the water). As a result, the center of gravity of the child is lowered, making it more difficult for the toy 102 to tip over.

Figure 3B:
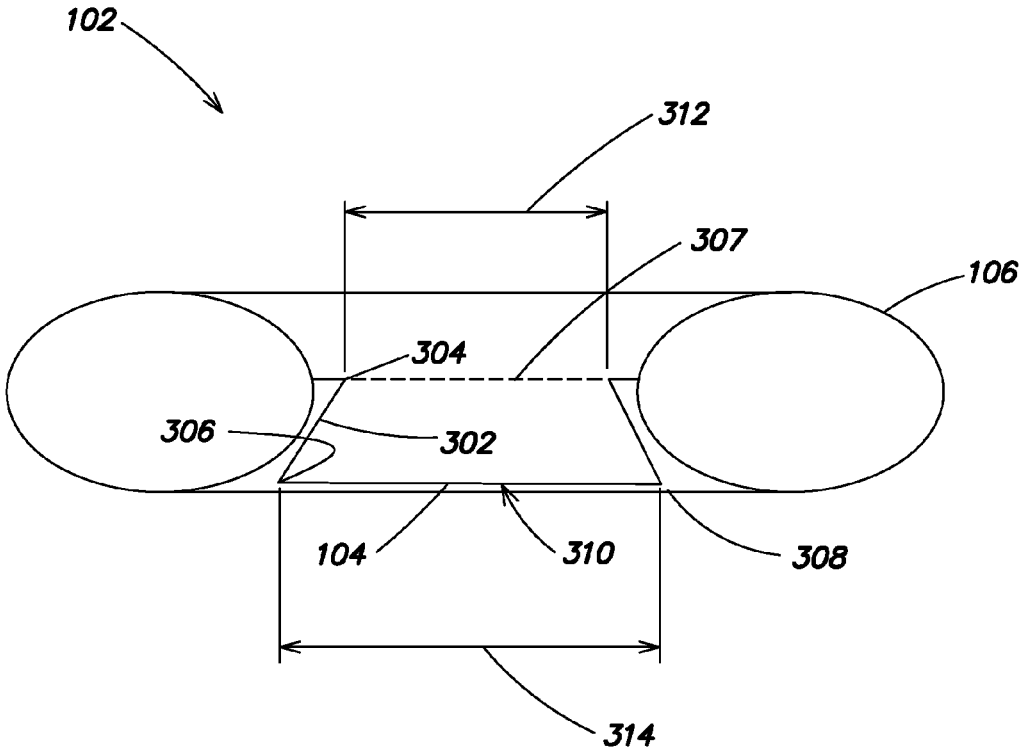
FIG. 3B is a cross sectional diagram of a bucket seat of a floating pool and beach toy in accordance with aspects of the present invention.

FIG. 3B illustrates a cross sectional diagram of a bucket seat 310 coupled to a floating pool and beach toy 102. As discussed above, according to one embodiment, the side wall 302 is coupled between the seat portion 104 and the flotation device 106. According to one embodiment, the side wall 302 is welded to the flotation device 106 around an edge 304 of an opening 307 and to the seat portion 104 around an edge 306. According to one embodiment, the side wall 302 extends downward from the edge 304 to the seat portion 104, which is located below the edge 304 and proximate a bottom portion 308 of the flotation device 106, creating a bucket seat.

According to one embodiment, the side wall 302 extends downwardly at an outward angle. For example, in one embodiment, as the side wall 302 extends from the edge 304 towards the seat portion 104, the side wall 302 expands outward, causing the diameter 312 of the edge 304 around the flotation device 106 to be smaller than the diameter 314 of the edge 306 around the seating portion 104. Due to the "beveling" of the side wall 302, a child placed on the seat portion 104, through the opening 307 with his/her feet through the apertures 108, will fit more securely, more comfortably, and with more stability in the bucket seat 110.

Figure 3C:
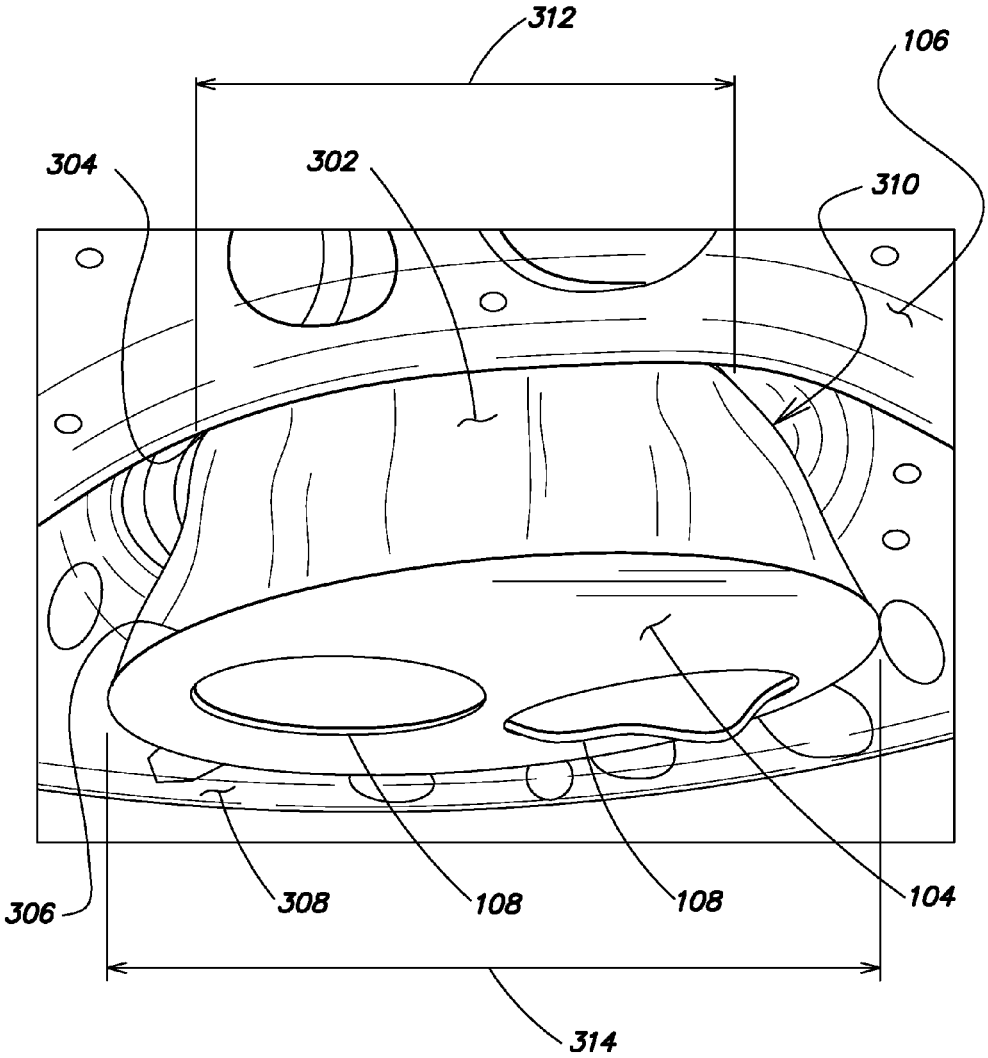
FIG. 3C illustrates a bucket seat of a floating pool and beach toy in accordance with aspects of the present invention.

FIG. 3C illustrates a bucket seat 310 of a floating pool and beach toy 102 in accordance with aspects of the present invention. As discussed above, according to one embodiment, the side wall 302 is coupled between the seat portion 104 and the flotation device 106. According to one embodiment, the side wall 302 is welded to the flotation device 106 around an edge 304 and to the seat portion 104 around an edge 306. According to one embodiment, the side wall 302 extends downward from the edge 304 to the seat portion 104, which is located below the edge 304 and proximate a bottom portion 308 of the flotation device 106, creating a bucket seat.

According to one embodiment, the side wall 302 is beveled. For example, in one embodiment, as the side wall 302 extends from the edge 304 towards the seat portion 104, the side wall 302 expands outward, causing the diameter 312 of the edge 304 around the flotation device 106 to be smaller than the diameter 314 of the edge 306 around the seating portion 104. Due to the beveling of the side wall 302, a child placed on the seat portion 104, through the opening 307 with their feet through the apertures 108, will fit more securely, and with more stability, in the bucket seat 110.

Figure 4:
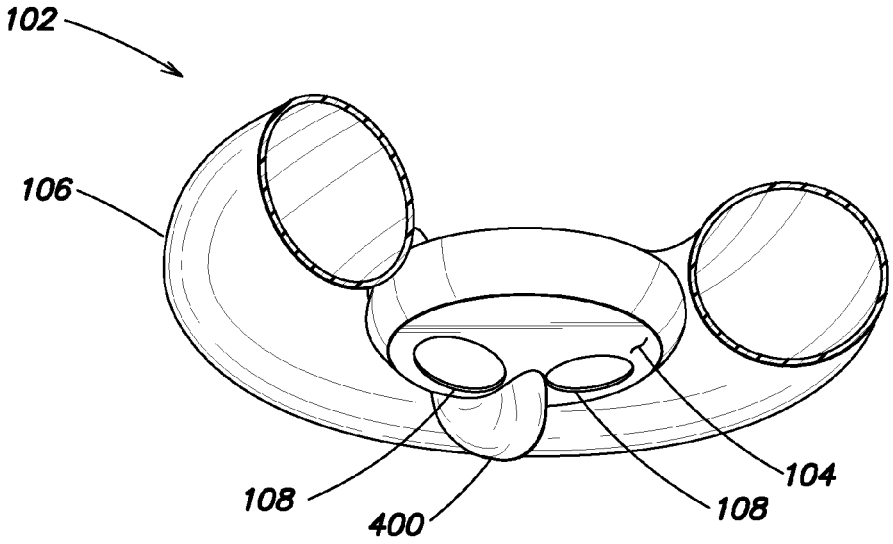
FIG. 4 is a cross section diagram of a floating pool and beach toy including a stability keel in accordance with aspects of the present invention.

According to another embodiment, the floating pool and beach toy 102 also includes a stability keel 400. FIG. 4 is a cross section diagram of a floating pool and beach toy 102 including a stability keel 400 in accordance with aspects of the present invention. According to one embodiment, the stability keel 400 is coupled to the seat portion 104 between the apertures 108 and extends downward, away from the seat portion 104. In one embodiment, the stability keel 400 extends four inches away from the seat portion 104. However, in other embodiments, the stability keel 400 may be located in any appropriate location on the toy 102 and may be of any size. According to one embodiment, the keel 400 is filled with water to provide added weight; however, in other embodiments, the keel 400 may be weighted with any appropriate material, such as sand. The stability keel 400 lowers the center of gravity of the toy 102, making the toy 102 more stable and less likely to tip over.

Figure 5:
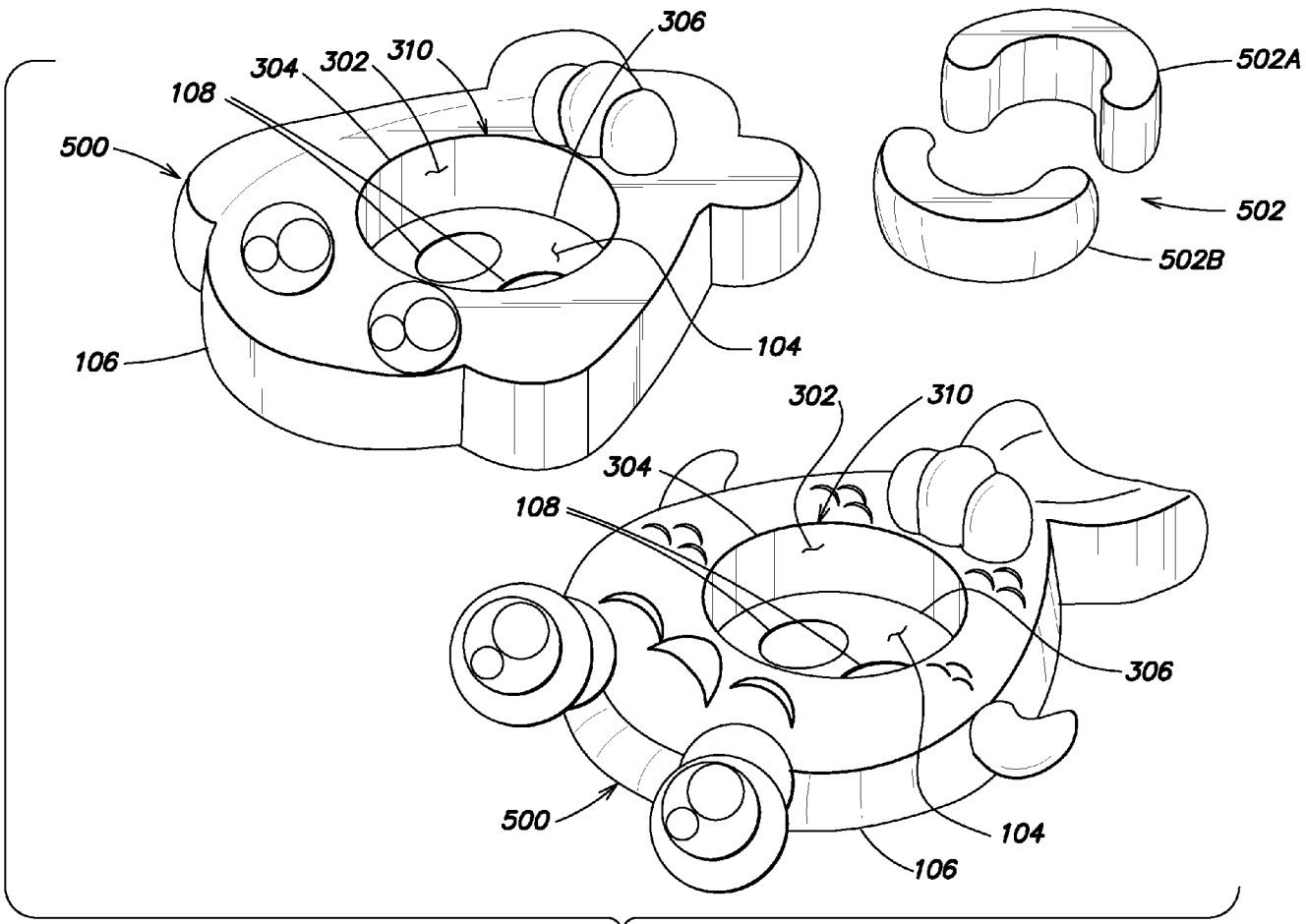
FIG. 5 illustrates a floating pool and beach toy and a size compensator in accordance with aspects of the present invention.

According to one embodiment, a floating pool and beach toy may also include a size compensator. FIG. 5 illustrates floating pool and beach toys 500 and a size compensator 502 in accordance with aspects of the present invention. The floating pool and beach toys 500 are substantially the same as the floating pool and beach toy 102 described above. In each toy 500, the side wall 302 is coupled between a seat portion 104 and a flotation device 106. According to one embodiment, the side wall 302 is welded to the flotation device 106 around an edge 304 and to the seat portion 104 around an edge 306. According to one embodiment, the side wall 302 extends downward from the edge 304 to the seat portion 104, which is located below the edge 304 and proximate a bottom portion 308 of the flotation device 106, creating a bucket seat.

As discussed above, according to one embodiment, a young child's legs (not shown) are inserted into apertures 108 in the seat portion 104 and the seat portion 104, in cooperation with the flotation device 106, supports the weight of the child and keeps the child afloat while the flotation device 106 rests on top of the water.

Figure 6:
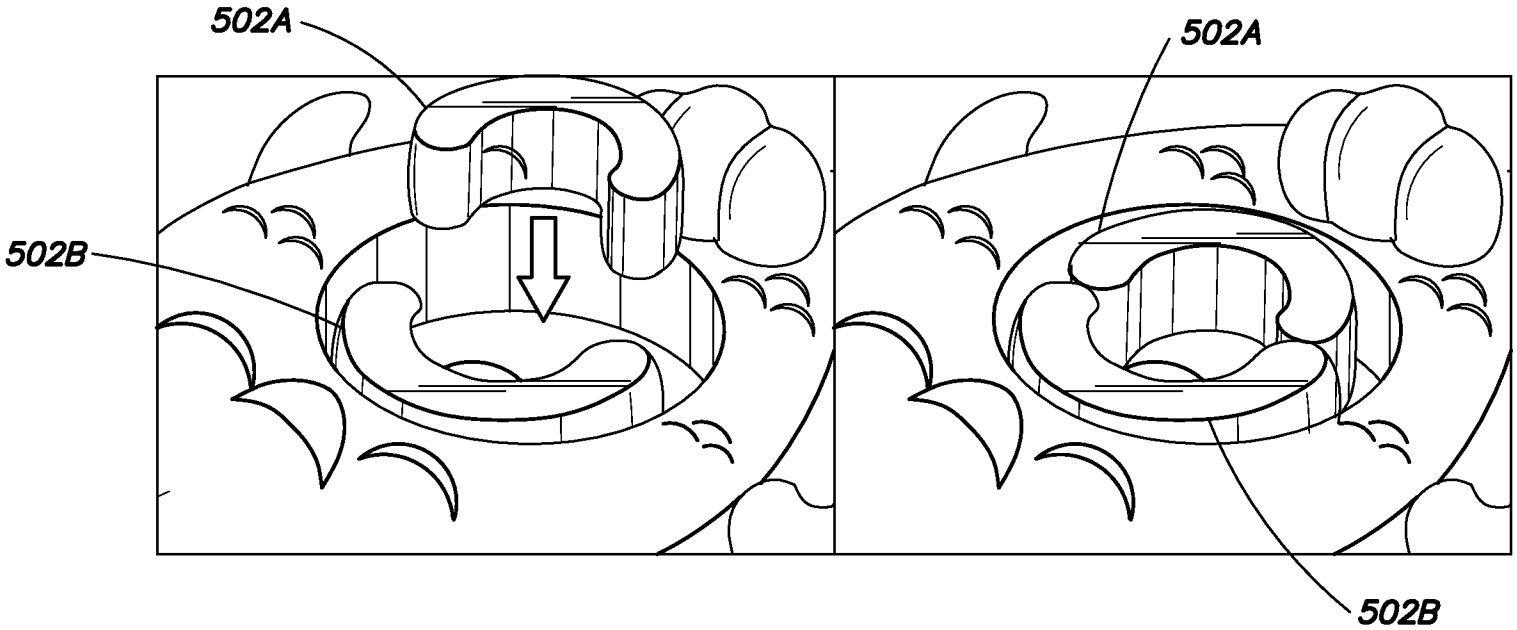
FIG. 6 illustrates a combination of a floating pool and beach toy and a size compensator in accordance with aspects of the present invention.

According to another embodiment, the floating pool and beach toys 500 may also include a size compensator 502. For example, in one embodiment, the size compensator 502 includes a first portion 502A and a second portion 502B. As seen in FIG. 6, the first portion 502A and the second portion 502B are configured to be inserted within the bucket seat 310.

Once inserted into the bucket seat 310, the first portion 502A and the second portion 502B are combined to form a ring which is configured to encircle the apertures 108. As a result, the size compensator 502 also encircles a child that is seated in the bucket seat 310 (e.g., around the child's midsection). According to one embodiment, interposing the size compensator 502 between a child and the bucket seat 310 holds the child more firmly within the bucket seat 301, creating a more stable and secure seat. According to one embodiment, the size compensator 502 is inflatable so that it is adjustable to provide a fit specific to the child sitting in the bucket seat 301.

According to one embodiment, elements of a floating pool and beach toy as described herein may be constructed of plastic material. For example, in one embodiment, the plastic material is Polyvinyl Chloride (PVC), reinforced PVC, PVC mesh, laminated PVC or any other plastic material. In one embodiment, the plastic material is transparent. In another embodiment, the plastic material includes decorative ornamentation.

As described herein, according to one embodiment, the side wall is welded to the flotation device around an edge of a circular opening to form a circular side wall; however, in other embodiments, a side wall may be welded to the flotation device in any configuration to form any shaped side wall.

By including such enhanced safety features as the large flotation device, the bucket seat, the stability keel, and/or the size compensator, a safer, more stable and more buoyant floating pool and beach toy is provided.

Having thus described at least one embodiment of the present disclosure, various alternations, modifications and improvements will readily occur to those skilled in the art. Such alterations, modifications and improvements are intended to be within the scope and spirit of the disclosure. Accordingly, the foregoing description is by way of example only and is not intended to be limiting. The disclosure's limit is defined only in the following claims and equivalents thereto.

What is claimed is:

1. A construction for a float, the construction comprising:
- a flotation device having a top portion, a bottom portion and an opening disposed through the top portion and the bottom portion, the opening having a perimeter;
- a seat portion located proximate the bottom portion of the flotation device and having a perimeter; and
- a side wall coupled between the seat portion and the perimeter of the opening;
- wherein the seat portion is configured to support a user at a location proximate the bottom portion of the flotation device;
- wherein the side wall is beveled from the perimeter of the opening to the perimeter of the seat portion; and
- wherein the perimeter of the seat portion is larger than the perimeter of the opening.

2. The construction of claim 1, wherein the side wall comprises a first portion coupled to the flotation device around the perimeter of the opening and a second portion coupled to the perimeter of the seat portion.

3. The construction of claim 2, wherein the side wall extends downward from the perimeter of the opening towards the bottom portion of the flotation device.

4. The construction of claim 1, further comprising a keel coupled to the bottom portion of the flotation device.

5. The construction of claim 1, wherein the keel is weighted with water.

6. The construction of claim 1, further comprising a size compensator, wherein the size compensator is configured to be inserted into the flotation device through the opening and located proximate the seat portion.

7. The construction of claim 6, wherein the size compensator is removable from the flotation device.

8. The construction of claim 6, wherein the size compensator includes at least two pieces.

9. The construction of claim 6, wherein the size compensator is inflatable.

10. The construction of claim 1, wherein the flotation device is an inflatable tube having a cross sectional diameter of between eight to ten inches.

11. A construction for a float, the construction comprising:
- a flotation device having a top portion, a bottom portion and an opening disposed through the top portion and the bottom portion;
- a seat portion located within the opening; and
- a size compensator, wherein the size compensator is configured to be inserted into the flotation device through the opening and to be located proximate the seat portion;
- wherein the size compensator is further configured to encompass a portion of a user supported by the seat portion;
- wherein the size compensator is removable from the flotation device; and
- wherein the size compensator is inflatable.

12. The construction of claim 11, wherein the size compensator includes at least two pieces.

13. The construction of claim 11, further comprising a side wall coupled between an edge of the opening and an edge of the seat portion, wherein the seat portion is located proximate the bottom portion of the flotation device.

14. The construction of claim 13, wherein the side wall extends downward from the edge of the opening towards the bottom portion of the flotation device.

15. The construction of claim 13, wherein the side wall is beveled in relation to the top and bottom portions of the flotation device.

16. The construction of claim 11, wherein the flotation device is an inflatable ring having a cross sectional diameter of between eight to ten inches.

17. The construction of claim 11, further comprising a keel coupled to the bottom portion of the flotation device.

* * * * *